US009714814B2

(12) United States Patent
Dentler

(10) Patent No.: US 9,714,814 B2
(45) Date of Patent: Jul. 25, 2017

(54) UNIVERSAL RIFLESCOPE MOUNT FOR HAND-HELD WEAPONS

(71) Applicant: Daniel Dentler, Leutkirch (DE)

(72) Inventor: Daniel Dentler, Leutkirch (DE)

( * ) Notice: Subject to any disclaimer, the term of this patent is extended or adjusted under 35 U.S.C. 154(b) by 0 days.

(21) Appl. No.: 14/767,994

(22) PCT Filed: Jan. 23, 2014

(86) PCT No.: PCT/EP2014/000163
§ 371 (c)(1),
(2) Date: Aug. 14, 2015

(87) PCT Pub. No.: WO2014/124728
PCT Pub. Date: Aug. 21, 2014

(65) Prior Publication Data

US 2015/0377591 A1 Dec. 31, 2015

(30) Foreign Application Priority Data

Feb. 15, 2013 (DE) ..... 10 2013 002 606

(51) Int. Cl.
*F41G 11/00* (2006.01)
*F41G 1/41* (2006.01)

(52) U.S. Cl.
CPC ..... *F41G 11/004* (2013.01); *F41G 1/41* (2013.01); *F41G 11/001* (2013.01)

(58) Field of Classification Search
CPC ..... F41G 11/002–11/008
(Continued)

(56) References Cited

U.S. PATENT DOCUMENTS 1,835,576 A 12/1931 Sparr
2,306,997 A 12/1942 Burrell
(Continued)

FOREIGN PATENT DOCUMENTS

DE 202011002180 A1 8/2011
WO 2014124728 A1 5/1988

*Primary Examiner* — John D Cooper
(74) *Attorney, Agent, or Firm* — Browdy and Neimark, PLLC

(57) ABSTRACT

The invention relates to a riflescope mount for hand-held weapons, comprising at least one base rail (10) which is fixed to a weapon (23*a*, 23*b*, 23*c*) and which is detachably connected to at least one fixing at means connected to the riflescope (4*a*, 4*b*, 4*c*), wherein the base tail (10) that is mounted on the weapon (23*a*, 23*b*, 23*c*) comprises at least a mating plate (12, 12*a*) mounted on the weapon side or mounting elements on the weapon side, which is/are connected to the weapon (23*a*, 23*b*, 23*c*), and an adjusting plate (11, 11*a*) which is held on the mating plate (12, 12*a*) or the mounting elements such that the adjusting plate (11, 11*a*) can be adjusted in at least two mutually perpendicular plates, and on which the riflescope (4*a*, 4*b*, 4*c*) is detachably fixed via a receiving rail (7) or other mounting elements on the riflescope side, wherein, on the upper side of the adjusting plate (11, 11*a*) there is formed a separating plane (17), in the area of which the riflescope (4*a*, 4*b*, 4*c*), together with the receiving rail (7) thereof or other mounting elements on the riflescope side, can be removed from the weapon (23*a*, 23*b*, 23*c*) and transferred to another weapon (23*a*, 23*b*, 23*c*), wherein the receiving rail (7) to be mounted on the adjusting plate (11, 11*a*) or other mounting elements on the riflescope side is/are fixed detachably on the adjusting plate (11, 11*a*) by using fixing elements, and the association between the adjustment of the adjusting plate (11, 11*a*) and the mounting plate (12, 12*a*) always firmly connected on the weapon side
(Continued)

Figure 1:
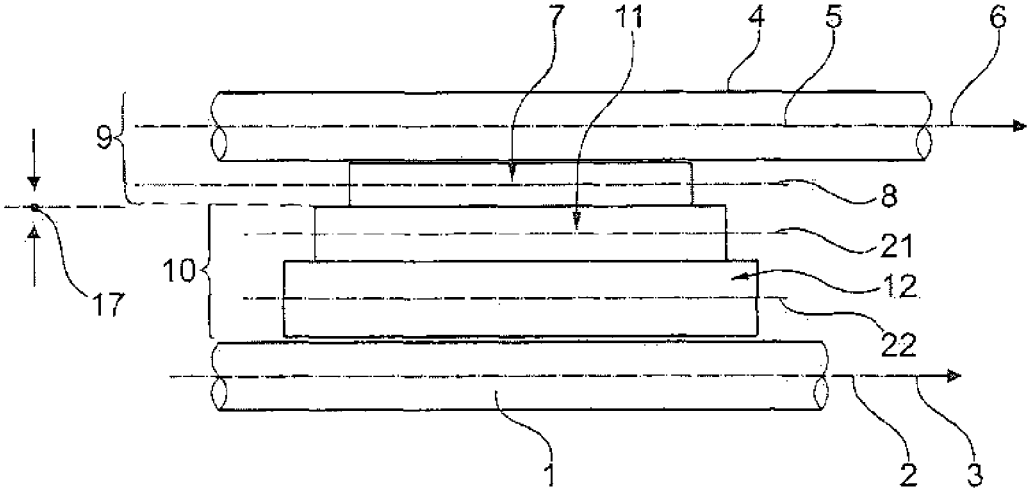

remains the same for said weapon and the other weapon (23*a,* 23*b,* 23*c*) and the associated riflescope (4*a,* 4*b,* 4*c*).

14 Claims, 4 Drawing Sheets

(58) Field of Classification Search
USPC ..... 42/125, 126
See application file for complete search history.

(56) References Cited

U.S. PATENT DOCUMENTS 2,576,007 A * 11/1951 Fischer ..... F41G 11/001 42/126
3,979,848 A * 9/1976 Ackerman, Jr. ..... F41G 1/26 42/126
4,216,600 A 8/1980 Brueckner et al.
4,742,636 A * 5/1988 Swan ..... F41G 11/006 42/126
5,274,941 A * 1/1994 Moore ..... F41G 11/005 42/126
5,625,954 A * 5/1997 DePaoli ..... F41G 1/345 42/113
5,787,630 A * 8/1998 Martel ..... F41G 11/003 42/125
6,295,754 B1 10/2001 Otteman et al.
6,591,538 B2 * 7/2003 Holler ..... F41G 11/007 42/125
7,543,405 B1 * 6/2009 Ivey ..... F41G 11/003 42/125
7,647,720 B1 * 1/2010 Vendetti ..... F41G 1/28 42/126
7,827,724 B1 * 11/2010 Spinelli ..... F41G 11/003 248/295.11
8,240,075 B1 * 8/2012 Mullin ..... F41G 1/38 42/119
8,296,991 B1 10/2012 Chung
8,407,924 B2 * 4/2013 Lee ..... F41G 1/473 42/111
9,052,163 B2 * 6/2015 Weigand ..... F41G 11/001
2006/0010759 A1 * 1/2006 Penney ..... F41G 11/001 42/126
2011/0099877 A1 5/2011 Sandler
2012/0085014 A1 4/2012 Riley et al.
2013/0008073 A1 * 1/2013 Clifton ..... F41G 1/387 42/125
2013/0174464 A1 * 7/2013 Chung ..... F41G 1/35 42/113

* cited by examiner

UNIVERSAL RIFLESCOPE MOUNT FOR HAND-HELD WEAPONS

The invention relates to a universal riflescope mount for hand-held weapons according to the preamble of claim 1.

Such a riflescope mount is known, for example, as the subject of DE 20 2011 002 180 U1. The known riflescope mount consists of a base rail to be mounted on the profile of the weapon by means of a clamp, said base rail having a longitudinally oriented profiled channel on its upper side which comprises the receiver for the riflescope which is to be inserted and fixed there.

The riflescope can thus be inserted into the receiving channel and singularly fixed there.

The base rail is likewise only connected singularly with the profile of the weapon by means of the clamp. The base rail is therefore in one part and has the disadvantage that a weapon can only be singularly allocated a single riflescope. In the allocation of the riflescope to the one-part base rail according to this prior art, it is necessary to sight-in the weapon together with the riflescope and to correspondingly adjust the riflescope, wherein the adjustment of the riflescope takes place on the adjustment apparatus of the riflescope.

If the user of the weapon now mounts the riflescope on a second weapon, the clamping lever of the one-part base rail is released and the base rail is placed along with the riflescope on the profile of a second weapon. However, this has the disadvantage that the scope is no longer sighted-in and adjusted on the second weapon, whereby a new adjustment of the riflescope is necessary.

This means that the riflescope adjustment with respect to the first weapon is lost, and may only be used on the second weapon. If the user now wishes to reset the riflescope onto the first weapon or to mount it onto a third weapon, according to DE 20 2011 002 180 U1 the adjusting device of the riflescope must be readjusted with respect to the one-part base rail with every transfer of the riflescope.

Adjusting means for adjusting the riflescope are known as the subject of U.S. Pat. No. 2,576,007 A, wherein an adjusting plate is non-adjustably disposed on the weapon. Adjustment takes place via a displacement of the riflescope itself.

U.S. Pat. No. 2,576,007 A relates to a carriage-like structure for mounting a riflescope by means of two half-shells which are fixed on a carriage. The carriage can be adjusted and fixed in longitudinal grooves on a weapon-side bracket, wherein the riflescope rests at its rear end on a height-adjustable bolt and is received at its front end in a prism-shaped receptacle.

It follows herefrom that removal of the riflescope is only possible if the retaining screw is completely removed, in order to remove the entire upper part with the half-shells from the weapon-side base rail. An adjusting plate is not disclosed. An adjustment in at least two mutually perpendicular planes is not provided.

A riflescope mount is known from U.S. Pat. No. 6,591,538 B2 in which an actuation of the adjusting means is only possible when the riflescope is removed. An transfer of the riflescope to another weapon without re-actuation of the adjusting means is therefore not possible.

It is thus not possible to construct a universal riflescope mount for hand-held weapons of a general type in which it is no longer necessary to readjust a riflescope which has been adjusted to a weapon when the riflescope is transferred to another weapon.

US2011/0099877A shows an accessory holder to which can be allocated a riflescope. The accessory holder is used to hold a light intensifier. The riflescope itself is fitted on the weapon with a fixed, non-adjustable holder.

On the basis of U.S. Pat. No. 6,591,538 B2, the object of the invention is to construct a universal riflescope mount for hand-held weapons of a general type in which it is no longer necessary that a riflescope which has been adjusted to a weapon must be readjusted when the riflescope is transferred to another weapon.

To achieve this object, the invention is characterized by the technical teaching of claim 1.

The invention thus provides a riflescope mount for hand-held weapons, comprising at least one base rail which is fixed to a weapon and which is detachably connected to at least one fixing means connected to the riflescope, wherein the base rail that is mounted on the weapon comprises at least a mating plate mounted on the weapon side or mounting elements on the weapon side, which is/are connected to the weapon, and an adjusting plate which is held on the mating plate or the mounting elements such that the adjusting plate can be adjusted in at least two mutually perpendicular planes, and on which the riflescope is detachably fixed via a receiving rail or other mounting elements on the riflescope side, wherein, on the upper side of the adjusting plate there is formed a separating plane, in the area of which the riflescope, together with the receiving rail thereof or other mounting elements on the riflescope side, can be removed from the weapon and transferred to another weapon, wherein the receiving rail to be mounted on the adjusting plate or other mounting elements on the riflescope side is/are fixed detachably on the adjusting plate by using fixing elements, and the association between the adjustment of the adjusting plate and the mating plate always firmly connected on the weapon side remains the same for said weapon and the other weapon and the associated riflescope.

A feature of the invention is thus that the base rail mounted on the weapon is constructed in at least two parts and comprises a weapon-side mating plate, which remains mounted on the weapon, and an adjusting plate adjustably mounted on the mating plate, said adjusting plate likewise remaining on the weapon once adjusted and on which adjusting plate the riflescope is detachably and interchangeably fixed.

With this technical teaching, a novel separating plane is defined, which is constructed on the upper side of the at least two-part weapon-side base rail and which provides that the riflescope with its riflescope-side fixing means, which will hereinafter be referred to for simplicity as a receiving rail, can always be removed from the weapon and transferred to another weapon without necessitating the alteration of the adjustment of the riflescope to the weapon-side base rail.

This is achieved according to the invention in that for the at least two-part base rail, the adjusting plate, which is allocated to the weapon-side mating plate and which is disposed above the weapon-side mating plate, is adjustably constructed in at least two mutually perpendicular planes. It is thus only now possible that a plurality of weapons from the same or different manufacturers can be outfitted with a single riflescope without a loss of precision in the transfer to another weapon and without necessitating a change in the adjustment on the riflescope.

This means that any riflescope can be changed onto any desired weapon as often as desired through a one-time only sighting-in, without a loss of precision.

In this way, if a new riflescope is introduced, it need only be sighted-in on one of these weapons, and thus fits on all other weapons without a loss of precision.

Said universal riflescope mount may be used for any desired hand-held weapon, such as hunting and sporting guns, but also for handguns, pistols, revolvers, rifles, carbines and automatic weapons.

It can be used not only for sporting and hunting weapons, but also for all types of hand-held weapons.

An essential feature of the invention is thus that the base rail mounted on the weapon consists of at least one weapon-side mating plate or of weapon-side mounting elements which is/are connected with the weapon, and of an adjusting plate adjustably mounted on the mating plate or the mounting elements, said adjusting plate being fixed directly or indirectly on the riflescope.

A two-part base rail is preferably used which comprises a permanently mounted weapon-side mating plate (or mounting elements equivalent thereto), on which an adjusting plate is disposed which is adjustable in at least two mutually perpendicular spatial axes. A receiving rail is fixed on the adjusting plate, which in turn is fixedly connected with the riflescope.

The use of a receiving rail to mount the riflescope is, however, only to be understood by means of example. Instead of a receiving rail, other types of fastenings may be used, such as two stud bolts which are spaced apart from one another, which are detachably connectable with the adjusting plate or the receiving rail is directly integrated into the body of the riflescope.

The separating plane according to the invention is located on the underside of the riflescope-side receiving rail and on the upper side of the adjusting plate, the adjusting plate being adjustable in at least two spacial axes, so that the riflescope can always be removed from the weapon with the receiving plate fixed on the riflescope and transferred to another weapon.

Each weapon is thus allocated a two-part base rail, wherein according to the invention, during sighting-in of the weapon the adjusting plate is adjusted on the base rail to the riflescope.

The term "two-part base rail" also comprises a one-part base rail, the second part of which—the "weapon-side mating plate" is incorporated directly onto the weapon or comprises only weapon-side fasteners, such as bolts or clamping elements, which take over the function of the weapon-side mating plate. The term "plate" in the weapon-side mating plate is therefore to be understood in its broadest sense. Therefore, in the characterizing part of claim 1, this type of weapon-side fixing means is designated generally as a "mounting element."

The allocation of the adjustment of the adjusting plate to the permanently connected weapon-side mating plate remains the same for every weapon and corresponding riflescope.

If thereafter the riflescope is removed from a weapon and transferred to another weapon, the adjustment between the adjusting plate and the mating plate on the second weapon is set up precisely such that the riflescope is aligned and sighted-in on the second weapon with this adjustment.

The invention therefore provides that for the at least two-part, weapon-side base rail, the adjusting plate is designed so as to be adjustable to the mating plate fixed on the weapon by means of any desired adjusting means.

Any desired adjusting means may be used as an adjusting means, such as wedge means, screws, spindle elements, eccentric elements, rotary excenters or clamp excenters and the like.

For the sake of simplicity of description, these adjusting means will no longer be specifically mentioned, as they are left to the discretion of one skilled in the art.

The two-part base plate preferably comprises a metallic material, but can also comprise plastic or a metal-plastic composite. The mating plate fixed on the weapon-side is fixed on the weapon with any desired fixing means, such as a screw, clamp connection, an adhesive connection and the like. It is also possible that this mating plate is prefabricated on the weapon or replaced only by weapon-side fixing elements. After initial mounting, it may remain on the weapon.

The adjusting plate is adjustably designed with respect to the fixedly attached weapon-side mating plate.

The orientation of the adjusting plate is also possible via a rotational motion and not only through laterally parallel displacement, but also by an oblique lateral displacement.

The receiving rail detachably mounted on the adjusting plate is fixed on the adjusting plate with any desired fixing elements. Such detachable fixing elements are, for example, clamping screws, clamping levers, clamp excenters, rotary excenters or wedge elements.

It is essential that a form-fitting positive fit is achieved between the riflescope-side receiving rail and the weapon-side adjusting plate in the fixed state.

The invention differs in comparison to U.S. Pat. No. 6,591,538 B2 in that the separating plane for the removal of the riflescope is formed above the weapon-side adjustable adjusting plate, such that it is possible for the first time that a plurality of weapons from the same or different manufacturers can be outfitted with a single riflescope without a loss of precision in the transfer to another weapon and without necessitating a change in the adjustment of the riflescope.

This means that any riflescope can be changed onto any desired weapon as often as desired through a one-time only sighting-in, without a loss of precision.

This is because, according to the invention, the mating plate, with the adjusting plate thereover, is fixed to the weapon itself and the adjusting plate is adjusted singularly to a specific riflescope. The adjusting plate, which is adjusted singularly on the weapon to a riflescope associated therewith, always remains on the weapon itself.

If the riflescope with the receiving rail thereunder or other weapon-side mounting elements is now removed from its secured and positive fit from the upper side of the adjusting plate and set on a different weapon, it is provided that the adjusting plate on the other weapon is likewise adjusted to the riflescope.

It is thus possible for the first time that one can use one or more different riflescopes on any desired weapons, as each weapon is allocated a singularly adjusted adjusting plate which remains on the weapon and remains fixedly adjusted.

The further advantage thus also exists that one may place different riflescopes on a respective adjusting plate on the weapon, without a loss of precision.

The inventive subject of the present invention arises not only from the subject of the individual claims but also from the combination of the individual claims with one another.

All information and features disclosed in the documents, including the abstract, in particular the spatial embodiment shown in the drawings, are claimed as essential to the invention insofar as they are novel with respect to the prior art, either individually or in combination.

The invention is hereinafter described in greater detail with reference to drawings showing only one possible embodiment. From the drawings and their description follow further features and advantages essential to the invention.

Figure 2:
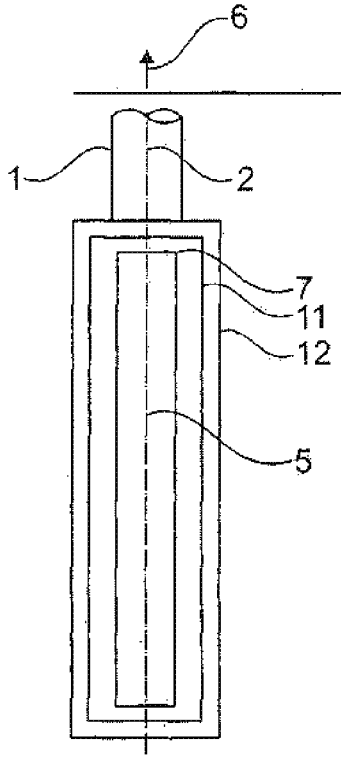
Figure 3:
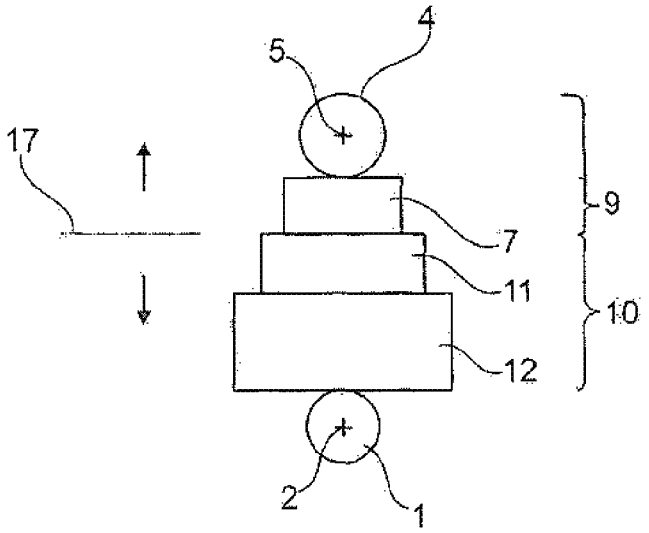

FIG. 1: shows a schematic side view of a universal riflescope mount according to the invention in an equipped state on a first weapon FIG. 2: shows a top view of the arrangement according to FIG. 1 in an equipped and adjusted state FIG. 3: shows an end view of the first weapon according to FIGS. 1 and 2

Figure 4:
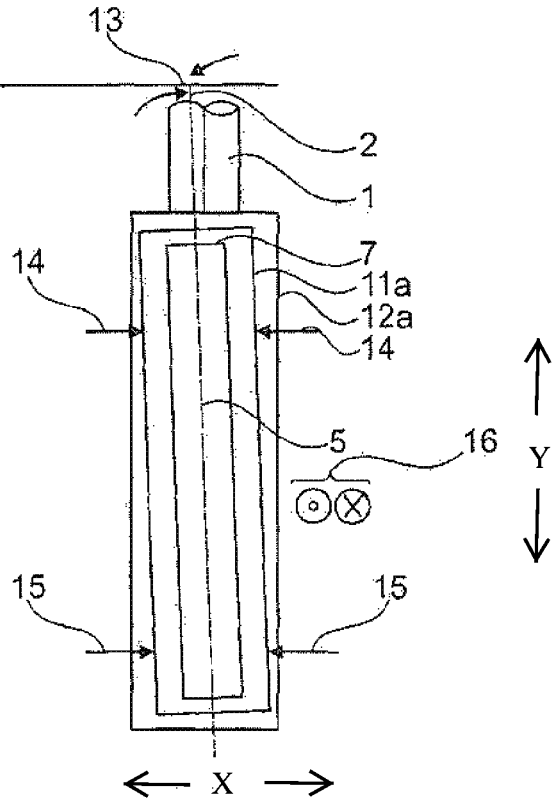
Figure 5:
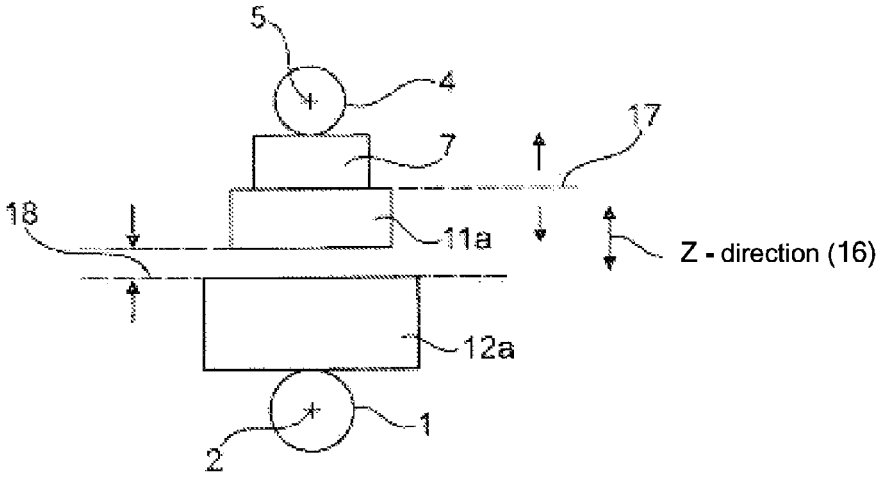
Figure 6:
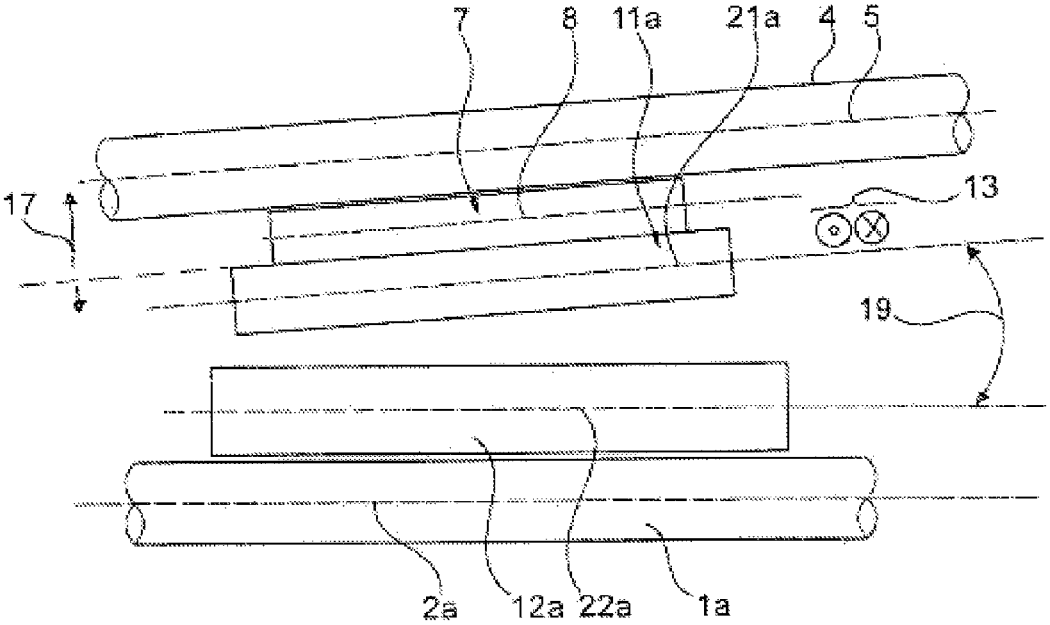
Figure 7:
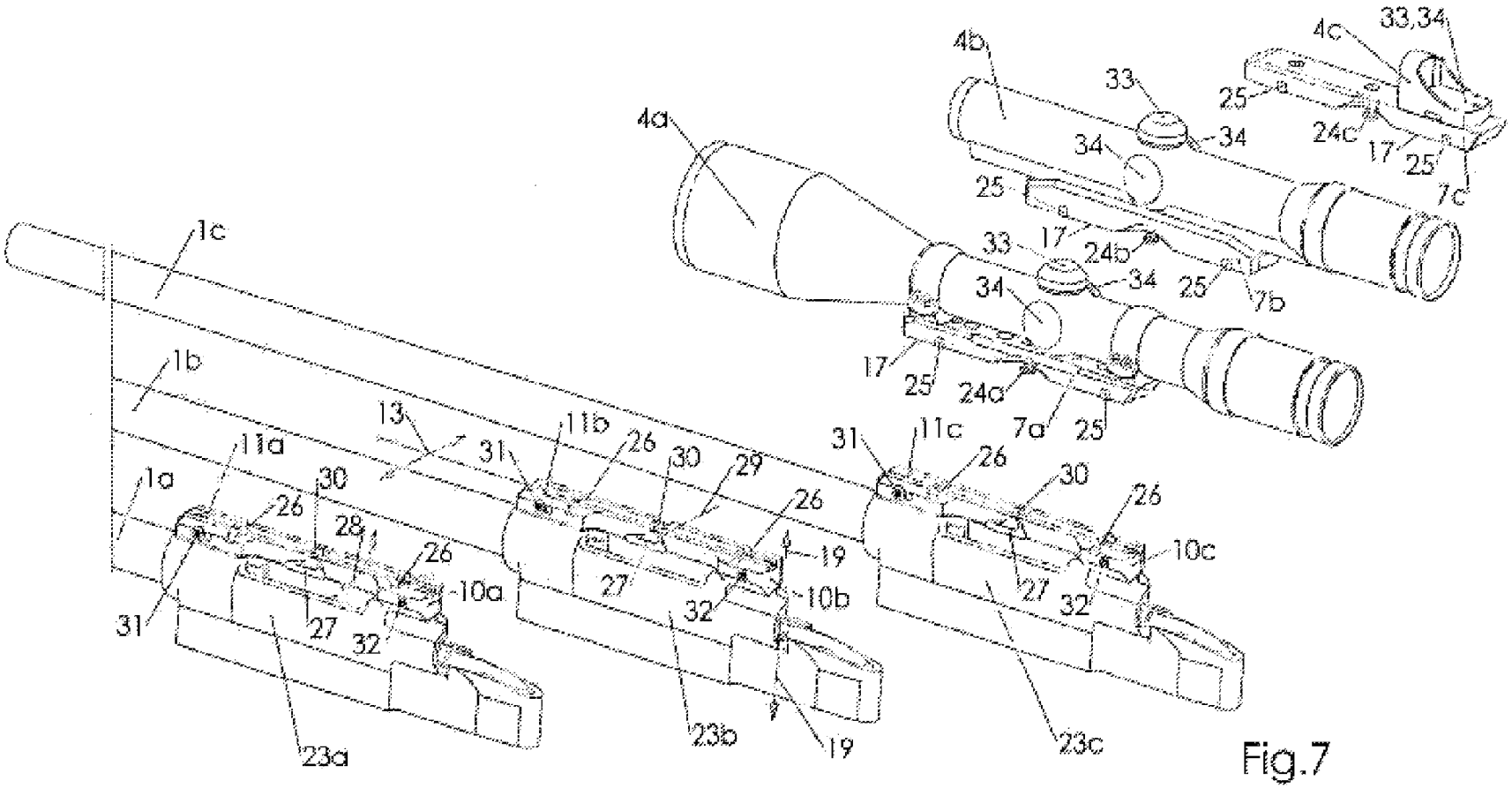

FIG. 4: shows a top view of the arrangement of a second weapon when the riflescope of the first weapon is mounted on a second weapon FIG. 5: shows an end view of the riflescope mount on the second weapon FIG. 6: shows a side view of the riflescope mount on the second weapon FIG. 7: shows a perspective view of the universal riflescope mount with representations of different weapons.

In the illustrations, a weapon barrel 1 is schematically represented, the longitudinal axis 2 of which is pointed in a particular arrow direction 3, the shot being released in this arrow direction.

The weapon barrel 1 is allocated a riflescope 4, which is aligned with its optical axis 5 to the target to be hit (for instance at a distance of 100 meters), wherein the optical axis 5 having the arrow direction 6 must correspond in the area of approximately 100 meters with the release of the shot in arrow direction 3. The weapon is thus sighted-in together with the riflescope on a target at a distance of 100 m.

According to the invention, an at least two-part base rail 10 is mounted on the weapon barrel 1, the base rail comprising a lower mating plate 12 directly fixed on the weapon, which forms a longitudinal axis 22.

An adjusting plate 11 adjustable in at least two spatial planes is mounted on the mating plate 12 and designed to be adjustable and fixable by means of adjusting means. In a preferred embodiment, it is displaceable in the X-Y plane and additionally adjustable in inclination. Regarded is therefore an adjusting plate which is adjustable in three spatial directions (X, Y, Z).

According to FIG. 1, a receiving rail 7 is detachably fixed on the adjustable adjusting plate 11, the receiving rail remaining fixed on the riflescope.

According to the invention, the separating plane 17 is thus formed in the universal riflescope mount on the underside of the riflescope-side receiving rail 7 and the upper side of the weapon-side adjustably designed adjusting plate 11.

The riflescope thus forms the upper part 9 of the riflescope mount. The upper part comprises the riflescope 4 itself and the receiving rail 7 fixed to the riflescope.

The longitudinal axis of the adjusting plate 11 is designated as 21. The longitudinal axis of the receiving rail is designated as 8.

FIGS. 2 and 3 show the top view and the end view of a riflescope 4 adjusted on the weapon barrel 1.

It can be seen here that the optical axis 5 of the riflescope 4 approximately matches the longitudinal axis 2 of the weapon barrel 1, so that the riflescope sights in the same longitudinal axis as the firing of the shot in arrow direction 3.

This is indicated by the arrow direction 6.

FIG. 3 shows an end view in which the allocation of said parts can be seen. It is essential here that the separating plane 17 is formed between the upper side of the adjusting plate 11 and the underside of the riflescope-side receiving rail 7.

If such an arrangement is transferred to a second weapon, said parts are separated from one another in the separating plane 17, and the upper part 9 (including the riflescope 4) is placed on a second weapon. This is evident in FIGS. 4 to 6.

The second weapon is shown in FIGS. 4 to 6. All parts of the second weapon are designated with the letter "a." It can be seen that the weapon-side adjusting plate 11 a and the mating plate 12*a* mounted on the second weapon may possibly now be displaced with respect to the weapon barrel of the second weapon. This is due to the angle of deviation 13 which is established in the X direction.

The adjusting means 14, 15, 16 are now actuated, wherein for example the adjusting means 14, 15 act in the X-Y plane, while the adjusting means 16 acts in the Z plane perpendicular thereto.

These setting means allow the adjusting plate 11 a to be readjusted, so that a correct attachment is obtained for the riflescope 4. By means of the singular adjustment of the adjusting plate 11 a to the riflescope 4, the riflescope 4 is thus repeatably and singularly allocated to the singularly adjusted adjusting plate 11*a*, and this adjustment need not be changed.

The riflescope 4 can thus be placed with its receiving rail 7 on a weapon-side adjusted adjusting plate 11*a* and the associated mating plate 12*a* of the second weapon, and is immediately properly adjusted without the need for further adjustment.

Of course, this process can be repeated with additional weapons, whereby it is always necessary that an at least two-part base rail 10 is disposed on each weapon, which is formed from a mating plate 12 which is fixed to the weapon and an adjustable adjusting plate 11*a* or 11 connected to the mating plate.

FIGS. 5 and 6 show the adjustments that may be singularly necessary on the second weapon. In FIG. 5 is illustrated an adjustment path 18 that is here adjusted with the adjusting means 16 in the Z direction.

The letter a always indicates that the part belongs to the second weapon.

FIG. 6 shows the resulting angle of deviation 19 in the Z direction, which is adjusted by singular adjustment of the adjusting plate 11*a* remaining on the second weapon. The longitudinal axis 21 is set accordingly. Of course, the other longitudinal axes also change accordingly, as is shown in FIG. 6.

This is particularly true for the longitudinal axis 21*a* of the adjusting plate 11*a*.

The present invention makes clear that a universal riflescope mount for any desired hand-held weapon is provided in that the riflescope with a receiving rail 7 allocated thereto or another detachable mount is held on an at least two-part base rail, and that the base rail comprises a mating plate which is fixedly connectible to the weapon and an adjusting plate 11*a* which is displaceable and adjustable as well as fixable hereon.

The riflescope-side receiving rail 7 is thus detachably, form-fittingly and positively as well as securely fixed on the adjusting plate 11.

It is essential, therefore, that a separating plane 17 is formed on the upper side of the at least two-part, weapon-side base rail 10, in the region of which the riflescope 4 with its riflescope-side fixing means (for example receiving rail 7) is removable from the weapon 1 and transferable to another weapon, without necessitating a change in the adjustment of the riflescope to the weapon-side base rail 10, and that an adjusting plate 11 disposed above the weapon-side mating plate 12 is formed adjustably in at least two mutually perpendicular planes, on the upper side of which is formed the separating plane 17.

FIG. 7 shows the exchange system according to the invention for a universal riflescope mount, wherein with reference to an example of three different weapons 23*a*, 23*b*, 23*c* will be explained that on each of the individual weapons, a desired riflescope 4*a*, 4*b*, 4*c* can be mounted.

Characteristic of each weapon is the so-called weapon-side base rail 10, which comprises according to the drawing of FIG. 1 two mutually adjustable plates, namely the mating plate 12 which is directly mounted on the weapon barrel 1 and an adjusting plate 11 disposed thereover, which is designed adjustably to the mating plate 12.

In the illustrated embodiment, the mating plate 12 is not visible, but instead it is only the adjusting plate 11*a*, 11*b*, 11*c*, adjustably mounted on the mating plate 12, which is visible.

The three weapons are respectively denoted by the lowercase letters a, b, c. The same applies to the associated riflescope systems, which are therefore also denoted by the lowercase letters a, b, and c.

Because all weapon components and all riflescope components are identical, the corresponding numbers in the drawings are only partially designated by the lowercase letters a, b, c. For the sake of better clarity, identical parts are designated by the same reference characters, however are indicated on various weapons and parts thereof.

Accordingly, the adjusting plate 11*a*, 11*b*, 11*c* is adjustably mounted on each weapon 1*a*, 1*b*, 1*c*. The operation is performed once in the lateral adjustment direction 13 and secondly in the height adjustment direction 19.

Each riflescope system has on its underside a receiving rail 7*a*, 7*b*, 7*c*, which is firmly fixed on the bottom of the riflescope 4*a*, 4*b*, 4*c* and which is not adjustable.

Only the riflescope itself is adjustable to the receiving rail 7*a*, 7*b*, 7*c* laterally and in height. This is represented on each riflescope 4 by the height adjustment 33 and the lateral adjustment 34.

It is important that the receiving rail 7*a*, 7*b*, 7*c* can be directly coupled with the adjusting plate 11 and that no adjusting means are present in the region of the coupling. A non-displaceable, positive connection between the riflescope-side receiving rail 7 and the weapon-side adjusting plate 11*a*, 11*b*, 11*c* results in that a locking bolt 24*a*, 24*b*, 24*c* is disposed on the underside of the riflescope-side receiving rail 7, the locking bolt engaging in a corresponding clamp receiver 30 on the upper side of the adjusting plate 11*a*, 11*b*, 11*c* and being fixed by means of rotation of the clamping lever 27 in the direction of arrow 28 about the rotational axis 29.

The positive coupling of the respective riflescope-side receiving rail 7 on the weapon-side adjusting plate 11 further results in that two slot nuts 25 are arranged at a distance and parallel to one another on the underside of the riflescope-side receiving rail 7 and positively engage corresponding transverse grooves 26 which are disposed at a distance from one another on the surface of the adjusting plate 11, where said slot nuts are immovably and securely fixed.

According to a first embodiment of the present invention, it is provided that by means of the adjusting means 33, 34 on the riflescope and by means of the unchanged adjusting means on the weapon-side (the lateral adjustment screw 31 and height adjustment screw 32), an alignment of the riflescope with respect to the weapon barrel 1 takes place.

With the receiving rail 7 coupled to the adjusting plate 11, the riflescope is aligned with respect to the weapon barrel 1 by means of actuation of its adjusting means 33, 34 and the weapon 23 is thus sighted-in.

This embodiment thus relates to the first possibility of a universal adjustment such as occurs in an alignment of the riflescope 4 on the weapon-side of weapon barrel 1 with the adjusting means 33, 34 of the riflescope and with the unchanged adjusting means 31, 32.

A second embodiment of the universal adjustability relates to the fact that the riflescope 4 is mounted only in a central but discretionary position of the adjusting means of the riflescope, and is coupled to the weapon-side adjusting plate 11 in this as yet unadjusted positioning.

The riflescope is now aligned and sighted-in with the weapon barrel 1 on the target with an adjusting process and through actuation of the weapon-side adjusting means 31, 32.

Both types of adjustment are equally valid and one or the other type is applied through the choice of the user.

Hereafter will be described the universal riflescope mount.

It is assumed that the riflescope 4*a* has been aligned and sighted-in on the weapon 23*a*.

In order to enable a universal transferability of the same riflescope 4*a* to a second weapon 23*b* and/or a third weapon 23*c*, the following steps are taken:

1. The riflescope which has been aligned and sighted-in on the weapon 23*a* is removed from the weapon 23*a* and mounted on the weapon 23*b*. Nothing is changed on the riflescope-side adjusting means 33, 34.
2. Following the coupling of the riflescope 4*a* on the weapon 23*b*, the riflescope 4*a* is sighted-in on the target on the weapon 23*b*, in that the weapon-side adjusting means 31, 32 are actuated. The riflescope 4*a* is thus also aligned and sighted-in on the weapon 23*b*.
3. The same process applies for the further weapon 23*c*, which is merely shown by way of example, as there are any number of weapons and any number of riflescopes which can be mounted on the weapon.

Here, too, in the next step occurs the decoupling of the riflescope 4*a* from the weapon 23*b*, and the riflescope 4*a* is placed on the weapon 23*c* and the weapon 23*c* is sighted-in with the riflescope 4*a* through actuation of the weapon-side adjusting means 31, 32.

If the riflescope 4*a* mounted on the weapon 23*c* is now used again with the weapon 23*a*, it is sufficient to positively (and thus non-displaceably) couple the riflescope 4*a* with its riflescope-side receiving rail 7 on the weapon-side adjusting plate 11, without necessitating a change of the riflescope-side adjusting means 33, 34 or the weapon-side adjusting means 31, 32.

One can thus place and couple the riflescope 4*a* on any desired weapon 23*a*, 23*b*, 23*c*, because all of the weapon-side base rails 10 are aligned with the respective riflescope 4*a*.

The same process also applies to all other systems.

If another riflescope, for instance the riflescope 4*b* or 4*c*, is now mounted on the weapon 23*a*, 23*b*, 23*c*, the following applies:

The second or third riflescope 4*b*, 4*c* is now placed and coupled with the non-adjustably formed riflescope-side receiving rail 7*b*, 7*c* on the desired weapon-side base rail 10*a*, 10*b*, 10*c* with the fixedly adjusted adjusting plate 11*a*, 11*b*, 11*c*.

It is important here that nothing is changed on the weapon-side adjusting means 31, 32, but rather for the second and third riflescope only the riflescope-side adjusting means 33, 34 is changed when mounting on the weapon 23*a* is undertaken. The riflescope 4*b* is adjusted accordingly to the weapon 23*a*. This second riflescope 4*b* and logically also the third riflescope 4*c* thus now fit every weapon 23*a*, 23*b*, 23*c* which has been sighted-in with the riflescope 4*a*.

Namely, once the riflescope 4*b* has been zeroed-in on a weapon, for instance the weapon 23*a*, in that the riflescope-side adjusting means 33, 34 is actuated, a transfer of the second riflescope 4*b* or the third riflescope 4*c* to the further weapons 23*b* and 23*c* necessitates no new adjustment of the riflescope-side adjusting means 33, 34. Likewise, it is no longer necessary that the weapon-side adjusting means 31, 32 be actuated.

Herefrom arises the importance of the universal riflescope mount, as for every second and third and all further riflescopes, it is only necessary to adjust these second and third riflescopes 4*b*, 4*c* one time to a single weapon, for example the weapon 23*a*, wherein thereby the riflescope-side adjusting means 33, 34 are actuated, and thereafter the riflescope 4*b* and all further riflescopes can be transferred to any desired further weapons 23*b* and 23*c*, without necessitating a change of the weapon-side adjustments 31, 32 or the rifle-side adjusting means 33, 34.

An advantage of the universal riflescope mount is that the user may now possess a number of weapons, for instance the weapons 23*a*, 23*b* and 23*c* and a variety of different riflescopes 4*a*, 4*b*, 4*c*.

He can now mount in any desired manner each individual riflescope on each individual weapon, without needing to change anything on the riflescope-side adjusting means 33, 34 or the weapon-side adjusting means 31, 32. It is thus avoided that each weapon must be fixedly allocated to a single riflescope, which is sighted-in solely on this weapon and which may no longer for the entire period of use of the weapon be taken down from the weapon and used for another weapon.

This is therefore associated with the advantage that expensive riflescopes can be used and a single expensive riflescope can be used for a variety of weapons, resulting in universal applicability.

The coupling between the riflescope and the weapon-side always occurs without tools through actuation of the lever 27.

With the invention is also achieved a compatibility of weapons to a desired number of riflescopes, which was previously not possible.

If the weapon is used, for example, as a hunting weapon, it is known that the hunter preferably uses three different riflescopes that are adapted to the type of hunting. This could be, for example, a sitting game scope, a drive hunting scope and a reflex sight, respectively of high quality execution with a high degree of light amplification. It is only now possible to use such valuable scopes on a variety of hunting weapons, without the need for labor-intensive transfer and a loss of precision.

DRAWINGS LEGEND

1 weapon barrel (receiver/bascule/housing, sleeve)
2 longitudinal axis
3 directional arrow
4 riflescope
5 optical axis
6 directional arrow
7 receiving rail (riflescope 4)
8 longitudinal axis (of 7)
9 upper part
10 base rail (weapon-side)
11 adjusting plate 11*a*
12 mating plate 12*a*
13 angle of deviation (X-plane)
14 adjusting means
15 adjusting means
16 adjusting means
17 separating plane
18 adjustment path
19 angle of deviation (height)
20
21 longitudinal axis (of 11)
22 longitudinal axis (of 12)
23 weapon
24 locking bolt
25 slot nuts
26 transverse grooves
27 clamping lever
28 directional arrow
29 rotational axis
30 clamp receiver
31 weapon-side adjusting means (lateral adjustment screw)
32 weapon-side adjusting means (height adjustment screw)
33 riflescope-side adjusting means
34 riflescope-side adjusting means

The invention claimed is:

1. A riflescope mount for mounting a riflescope on hand-held weapons, comprising:

a receiving rail firmly fixed to a bottom side of the riflescope to detachably fix the riflescope to a first weapon, at least one base rail configured to be fixed to the first weapon and which is detachably connected to the receiving rail connected to the riflescope, wherein the at least one base rail that is mounted on the first weapon comprises:

a mating plate mounted on the first weapon, an adjusting plate adjustably connected directly to the mating plate on an opposite side of the first weapon, the adjusting plate configured to receive the receiving rail, and a first adjustment mechanism configured to adjust the adjusting plate in at least two mutually perpendicular planes, wherein, on an upper side of the adjusting plate there is formed a contiguous, uniform separating plane, in the area of which the riflescope, together with the receiving rail fixed thereto, is configured to be removed from the base rail attached to the first weapon and transferred to a second weapon, wherein the receiving rail to be mounted on the adjusting plate is directly and detachably fixed on the adjusting plate by fixing elements, wherein the fixing elements comprise:

a locking bolt disposed on an underside of the receiving rail, a clamp receiver disposed on an upper side of the adjusting plate and positioned so as to receive the locking bolt when the receiving rail is connected to the adjusting plate, and a clamping lever operatively connected to the clamp receiver, located on an outer surface of the adjusting plate, and configured to rotate about a rotational axis perpendicular to a longitudinal side of the adjusting plate from a locked position to an unlocked position to fix the locking bolt in the clamp receiver, wherein the receiving rail remains directly connected to the riflescope when the riflescope is removed from the first weapon and placed on the second weapon, and an association between adjustment of the adjusting plate and the mating plate always firmly connected on a weapon side remains the same for the first weapon and the second weapon and for each riflescope, wherein the adjusting mechanism is configured to selectively adjust the adjusting plate on the mating plate so as to be displaceable in the X-Y plane and additionally adjustable in inclination.

2. The riflescope mount according to claim 1, wherein the second weapon has attached thereto a base rail comprising a mating plate mounted on the second weapon and an adjusting plate adjustably connected directly to the mating plate to adjust the riflescope.

3. The riflescope mount according to claim 1, wherein the mating plate on the first weapon is configured to be fixedly mounted on the first weapon when the riflescope mount is in use, and the adjusting mechanism is configured to selectively adjust the adjusting plate in at least two mutually perpendicular spatial axes.

4. The riflescope mount according to claim 1, wherein the receiving rail detachably fixed on the adjusting plate is detachably connected with the riflescope.

5. The riflescope mount according to claim 1, wherein the riflescope is indirectly fixed on the adjusting plate.

6. The riflescope mount according to claim 1, wherein the fixing elements further comprises two slot nuts arranged at a distance from and parallel to one another on the underside of the receiving rail, and two transverse grooves disposed at a distance from one another on the upper surface of the adjusting plate and positioned so as to receive a respective one of the slot nuts to securely fix the slot nuts in the transverse grooves.

7. The riflescope mount according to claim 1, wherein the clamping lever is configured to be actuated to couple and uncouple the riflescope from the weapon as desired without tools.

8. A method for riflescope mounting of a riflescope on a first weapon having the following steps:

coupling the riflescope having a receiving rail fixed on an underside of the riflescope, to a first adjusting plate which is adjustable and fixed on the first weapon, and positively connected with the first weapon, wherein in the coupling comprising:

engaging a locking bolt disposed on an underside of the receiving rail in a clamp receiver disposed on an upper side of the first adjusting plate and positioned so as to receive the locking bolt when the receiving rail is connected to the first adjusting plate, and rotating a clamping lever operatively connected to the clamp receiver, located on an outer surface of the first adjusting plate, about a rotational axis perpendicular to a longitudinal side of the first adjusting plate from an unlocked position to a locked position to fix the locking bolt in the clamp receiver, sighting-in the first weapon on a target with the coupled riflescope, by adjusting first adjusting screws connected between the first adjusting plate and a first mating plate fixed on the first weapon to adjust the first adjusting plate laterally and at a selected angle of inclination and then locking the first adjusting screws in position, decoupling the riflescope from the first weapon by disengaging the receiving rail from the first adjusting plate, and coupling the riflescope with a second weapon by adjusting second adjusting screws between a second adjusting plate and a second mating plate fixed on the second weapon to adjust the second adjusting plate laterally and at a selected angle of inclination and then locking the second adjusting screws in position, and decoupling the riflescope from the second weapon by disengaging the receiving rail from the second adjusting plate and coupling the riflescope with the first weapon, while the first adjusting screws of the first weapon remain unchanged.

9. The method according to claim 8, wherein the coupling further comprises engaging two slot nuts arranged at a distance from and parallel to one another on the underside of the receiving rail in two transverse grooves disposed at a distance from one another on the upper surface of the first and second adjusting plates and positioned so as to receive a respective one of the slot nuts to securely fix the slot nuts in the transverse grooves.

10. The method according to claim 8, wherein the coupling further comprises actuating the clamping lever to couple and uncouple the riflescope from the weapon as desired without tools.

11. A method for riflescope mounting of a riflescope on a first weapon and on a second weapon having the following steps:

coupling the riflescope having a receiving rail fixed on an underside of the riflescope, on a first adjusting plate which is adjustable and fixable on the first weapon, and positively connected therewith, wherein in the coupling comprising:

engaging a locking bolt disposed on an underside of the receiving rail in a clamp receiver disposed on an upper side of the first adjusting plate and positioned so as to receive the locking bolt when the receiving rail is connected to the first adjusting plate, and rotating a clamping lever operatively connected to the clamp receiver, located on an outer surface of the first adjusting plate, about a rotational axis perpendicular to a longitudinal side of the first adjusting plate from an unlocked position to a locked position to fix the locking bolt in the clamp receiver, sighting-in the first weapon on a target with the coupled riflescope, by adjusting first adjusting screws connected between the first adjusting plate and a first mating plate fixed on the first weapon as desired to adjust the first adjusting plate laterally and at a selected angle of inclination and then locked or allowed to remain unchanged in their adjustment, the step of sighting-in further including actuating the first adjusting screws, decoupling the riflescope from the first weapon, coupling the riflescope with a second weapon and adjusting second adjusting screws connected between a second adjusting plate and a second mating plate to adjust the second adjusting plate laterally and at a selected angle of inclination and then locked or allowed to remain unchanged in their adjustment, and decoupling the riflescope from the second weapon and coupling the riflescope with the first weapon, while the first adjusting screws of the first weapon remain unchanged.

12. The method according to claim 11, further comprising:

mounting the riflescope in an unadjusted position of the first and second adjusting screws, and coupling the riflescope to the first and second adjusting plate in said unadjusted position.

13. The method according to claim 11, wherein the coupling further comprises engaging two slot nuts arranged at a distance from and parallel to one another on the underside of the receiving rail in two transverse grooves disposed at a distance from one another on the upper surface of the first and second adjusting plates and positioned so as to receive a respective one of the slot nuts to securely fix the slot nuts in the transverse grooves.

14. The method according to claim 11, wherein the coupling further comprises actuating the clamping lever to couple and uncouple the riflescope from the weapon as desired without tools.

* * * * *